US008191522B2

(12) United States Patent
Riley

(10) Patent No.: US 8,191,522 B2
(45) Date of Patent: Jun. 5, 2012

(54) VARYING THE PHASE AND LIFT OF A ROCKER ARM ON A CAMSHAFT ACTUATING A VALVE OR INJECTOR

(76) Inventor: Michael B. Riley, Fort Collins, CO (US)

( * ) Notice: Subject to any disclaimer, the term of this patent is extended or adjusted under 35 U.S.C. 154(b) by 754 days.

(21) Appl. No.: 12/247,105

(22) Filed: Oct. 7, 2008

(65) Prior Publication Data

US 2010/0083922 A1 Apr. 8, 2010

(51) Int. Cl.
*F01L 1/18* (2006.01)

(52) U.S. Cl. ..... 123/90.39; 123/90.16; 123/90.44; 74/569

(58) Field of Classification Search ..... 123/90.39, 123/90.44, 90.16; 74/559, 567, 569
See application file for complete search history.

(56) References Cited

U.S. PATENT DOCUMENTS 4,682,575 A 7/1987 Simko ..... 123/90.44
5,161,494 A 11/1992 Brown, Jr. ..... 123/90.11
5,335,636 A 8/1994 Bilei et al. ..... 123/321
5,365,895 A 11/1994 Riley ..... 123/90.16
5,572,962 A 11/1996 Riley ..... 123/90.16
6,354,265 B1 3/2002 Hampton et al. ..... 123/321
6,588,387 B2 7/2003 Cecur ..... 123/90.46

OTHER PUBLICATIONS

Blain R. Copenheaver, Notification of Transmittal of the International Search Report and The Written Opinion of the ISA, or the Declaration, Nov. 25, 2009.

*Primary Examiner* — Ching Chang

(57) ABSTRACT

In an internal combustion engine using poppet type valves, a center pivot rocker arm is moved through a specific path wherein the roller in contact with a cam is moved to alter the phasing of the valves or injectors in the engine. Depending on the interface between the valve or injector and the rocker arm, the rocker ratio of the rocker arm may be altered, giving a change in lift as well. By positioning a control arm at desired points on either side of a centered position, and rotating the control arm about its own pivot point via an arm actuator, phase change is achieved. The arm actuator controls the location of the control arm and thus the timing of the valve or injector relative to the rotation of the cam. Advanced, centered, and retarded phase change is possible depending upon the movement of the control arm.

31 Claims, 16 Drawing Sheets

VARYING THE PHASE AND LIFT OF A ROCKER ARM ON A CAMSHAFT ACTUATING A VALVE OR INJECTOR

FIELD OF THE INVENTION

This invention relates to an internal combustion engine using poppet type valves to direct gases into and out of one or more cylinders or cam operated fuel injection units to inject fuel into one or more cylinders. More particularly, a rocker arm is moved through a specific path wherein the roller in contact with a cam is moved to alter the phasing of the valves or injectors in the engine. Depending on the interface between the valve or injector and the rocker arm the rocker ratio of the rocker arm may be altered, giving a change in lift as well.

BACKGROUND OF THE INVENTION

Variable valve timing can be achieved by numerous methods. A description of a phasing system for roller lifter followers on a camshaft is given by Riley in U.S. Pat. No. 6,155,216, which is hereby incorporated by reference for all that is taught and disclosed therein. Variable cam timing, wherein the cam lobe is rotated relative to crank timing is given by Hampton in U.S. Pat. No. 4,754,727. This approach, of rotating the camshaft relative to the cam sprocket, is used by many engine manufacturers.

An alternative method is to move the rocker arm, with follower relative to the cam, as in U.S. Pat. No. 5,572,962 by Riley. In this case the phasing is achieved via a gearing system whereby the pivot shaft is moveable in a way that ties the change of phase to changes in lift and duration.

SUMMARY OF THE INVENTION

The present invention describes a system for providing controlled phasing in one embodiment (shown in FIGS. 1, 2A, 2B, 2C, 5A, and 5B), and controlled phasing with lift change in an alternative embodiment (shown in FIGS. 4, 6A, 6B, and 6C) of a center pivot rocker arm with a roller in contact with a cam. An alternate embodiment of providing the controlled movement path is shown in FIGS. 7A, 7B, 8A, and 8B.

One constraint in moving a rocker arm to change phase is that the height of the rocker arm tip on the valve stem or injector button must remain nearly constant, that is, within a very small, or minimal, range of vertical displacement. Another constraint is that the contact point between the rocker arm and the axis of the valve or injector will vary during actuation.

Allowing the roller of the rocker arm to move in an arc about the center of the cam (while maintaining contact with the base circle and the other end of the rocker maintaining contact with the valve stem or actuator button) results in the pivot shaft of the rocker arm describing its own arc. In most instances this rocker arm arc will be substantially circular. Allowing the path of the pivot shaft center to pivot about the center of that circle will deliver a phase change between the cam and the valve or injector with insignificant or minimal change in height of the contact point between the rocker arm tip and the valve stem or injector button, or a bridge acting on two valves.

DETAILED DESCRIPTION OF THE INVENTION

Figure 1A:
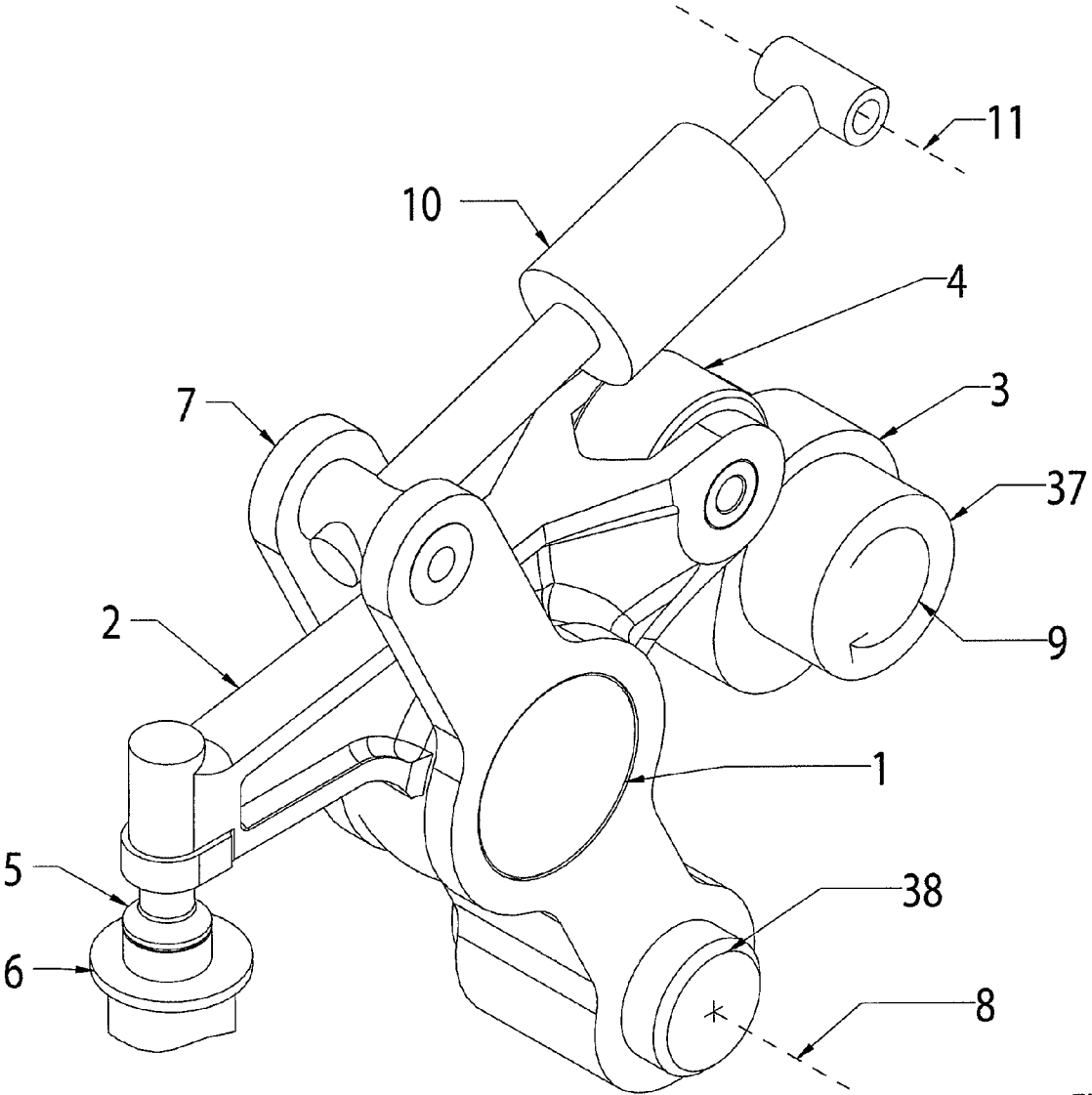
FIG. 1A shows an isometric view of a cam, rocker arm, valve or injector, and a pivot shaft for the rocker arm being carried by a separate pivoting mechanism.

Referring now to the Figures, in which like reference numerals refer to like components thereof, FIG. 1A shows an isometric view of a cam, rocker arm, valve or injector, and a pivot shaft for the rocker arm being carried by a separate pivoting mechanism. Though only one rocker arm, valve or injector, roller, control arm, and arm actuator are shown in FIG. 1A, one skilled in the art will recognize that two, three, four, or more sets of the same may be employed in any given engine.

In a conventional, center-pivot rocker arm for an overhead cam layout, pivot shaft 1 is in a fixed location, and rocker arm 2 pivots about this fixed location. Cam 3 attached to camshaft 37 acts on roller 4 (the roller 4 can be replaced by a curved sliding surface) to displace rocker arm 2. Curved arrow 9 indicates the direction of rotation of cam 3. The elephant's foot 5 attached to the tip of rocker arm 2 pushes down on valve or injector 6. The tip of rocker arm 2 usually has a mechanical or hydraulic lash adjuster which is not required to explain the function of the current invention, and is not shown. Valve or injector 6 is usually spring loaded (spring not shown) to return same to its original position as cam 3 returns to its base circle.

Figure 1B:
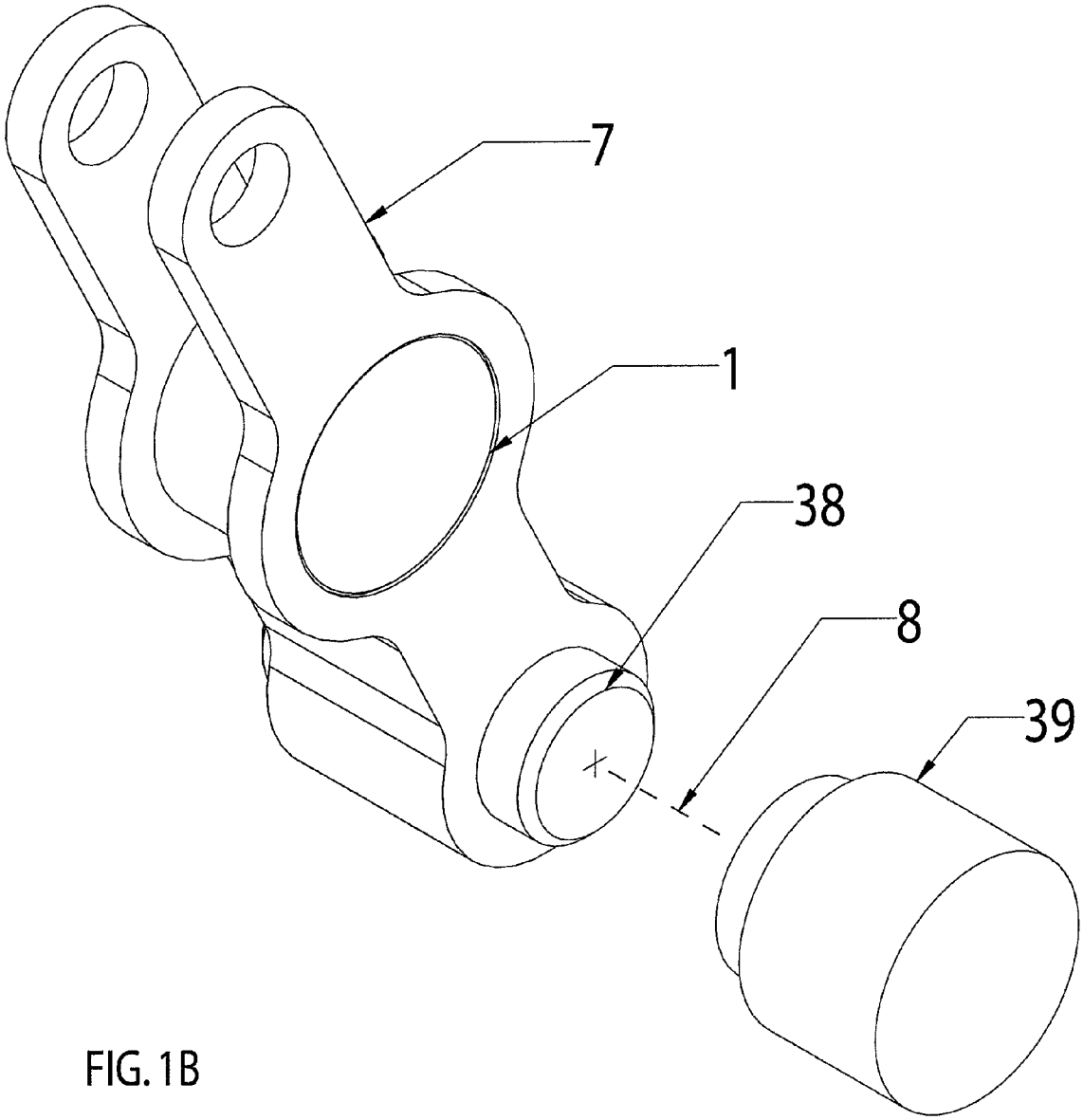
FIG. 1B shows an alternate embodiment that utilizes a rotational actuator.

Phase change is achieved in this invention by moving pivot shaft 1 through a circular arc centered about pivot axis 8 of shaft 38 fixed to control arm 7. In this embodiment this is shown by positioning control arm 7 at desired points on either side of a centered position, rotating control arm 7 about its own pivot axis 8 of shaft 38 via an arm actuator 10. Thus, in this embodiment, pivot shaft 1 is no longer fixed. Arm actuator 10 controls the location of control arm 7 by being able to vary its length from its actuator axis 11, and thus the timing of the valve or injector 6 relative to the rotation of cam 3 is changed. Arm actuator 10 may be a hydraulic actuator, a ball lead screw powered by an electric motor, which could be a stepper motor, or another type of rotary or linear actuator. In another embodiment shown in FIG. 1B, a rotating actuator 39 is attached to shaft 38 and rotates shaft 38 clockwise and counterclockwise in order to vary the phase.

Figure 2A:
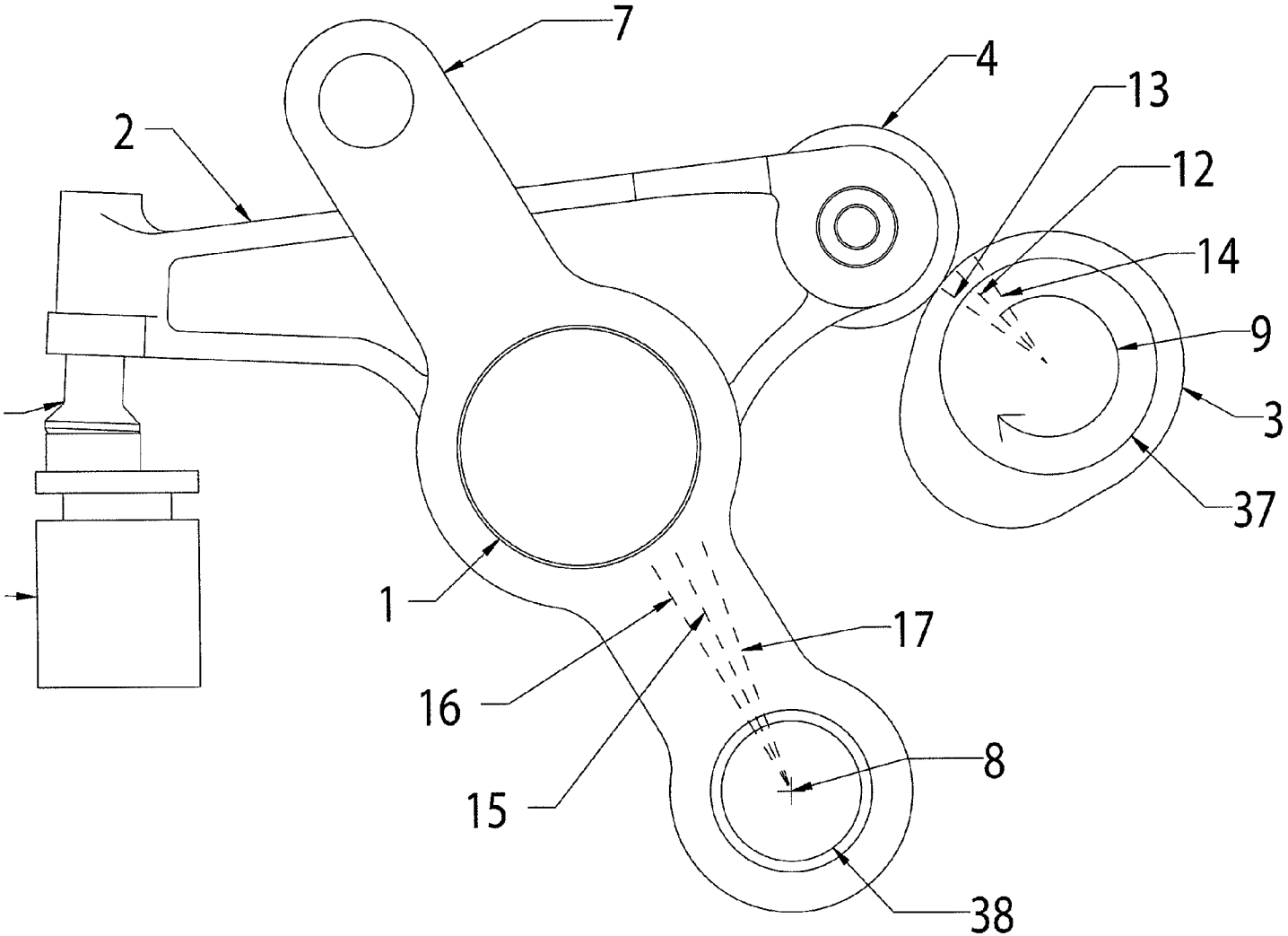
FIG. 2A shows a side-on view of the same mechanism as in FIG. 1A, with the rocker arm in a position of advanced timing.

FIG. 2A shows a side-on view of the mechanism in FIG. 1A with control arm 7 located in an advanced position from a centered position (arm actuator 10 and actuator axis 11 are not shown in this view). If pivot shaft 1 were held fixed (with a suitable locating mechanism in place of control arm 7) in a centered position this would correspond to a conventional design without variable timing. Dashed line 12 indicates the location of the centered timing position with roller 4 contacting cam 3 when on the base circle of the cam, which represents a zero phase change. Dashed line 13 indicates advanced timing (advanced phase change) and dashed line 14 indicates retarded timing (retarded phase change). Corresponding to these different timing indicators, dashed line 15 indicates control arm 7 in the centered position (zero phase position), dashed line 16 indicates the control arm 7 in the advanced phase position, and dashed line 17 indicates the control arm 7 in the retarded phase position.

Figure 2B:
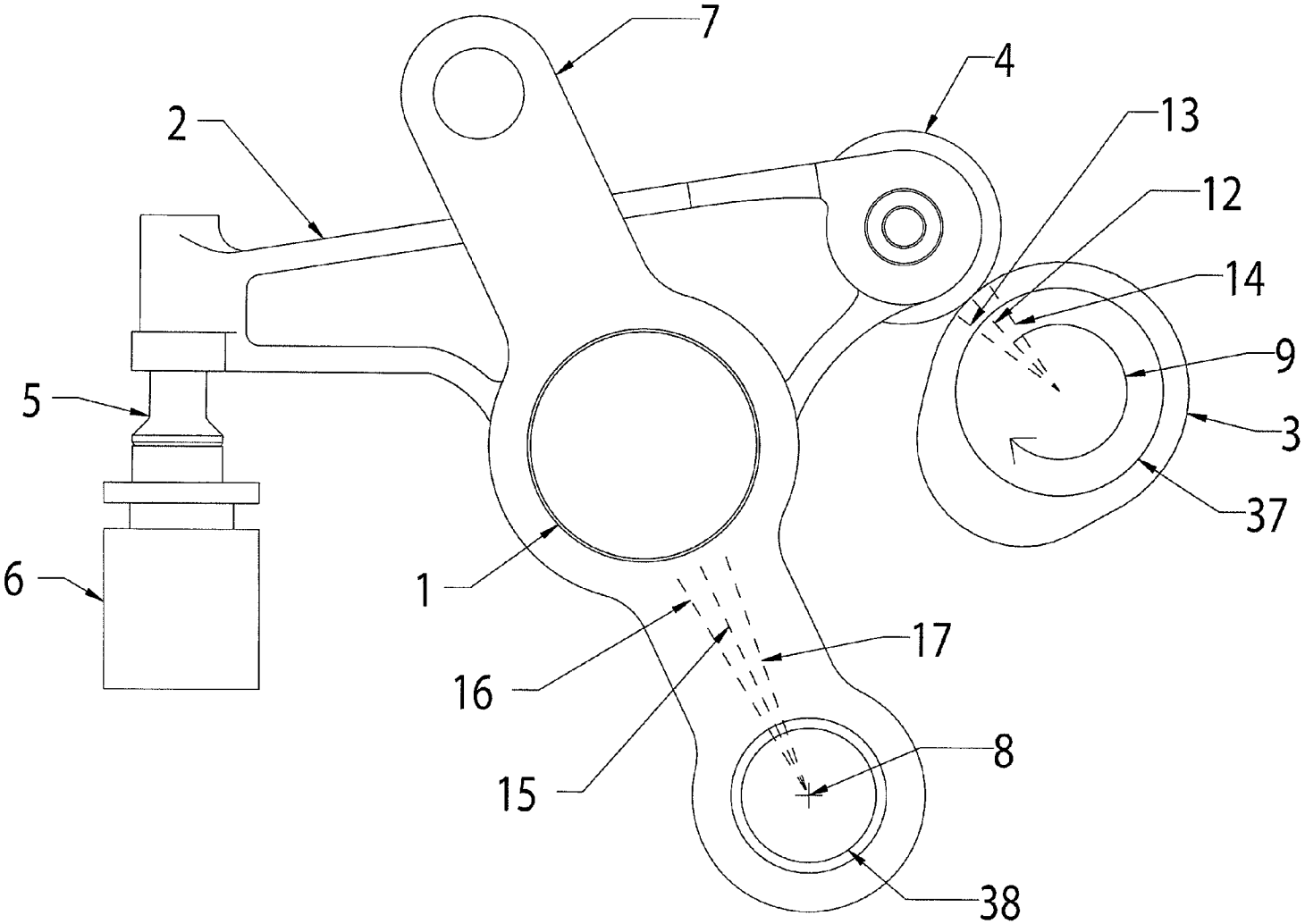
FIG. 2B shows a side-on view of the same mechanism as in FIG. 1A, with the rocker arm in a position of centered timing.
Figure 2C:
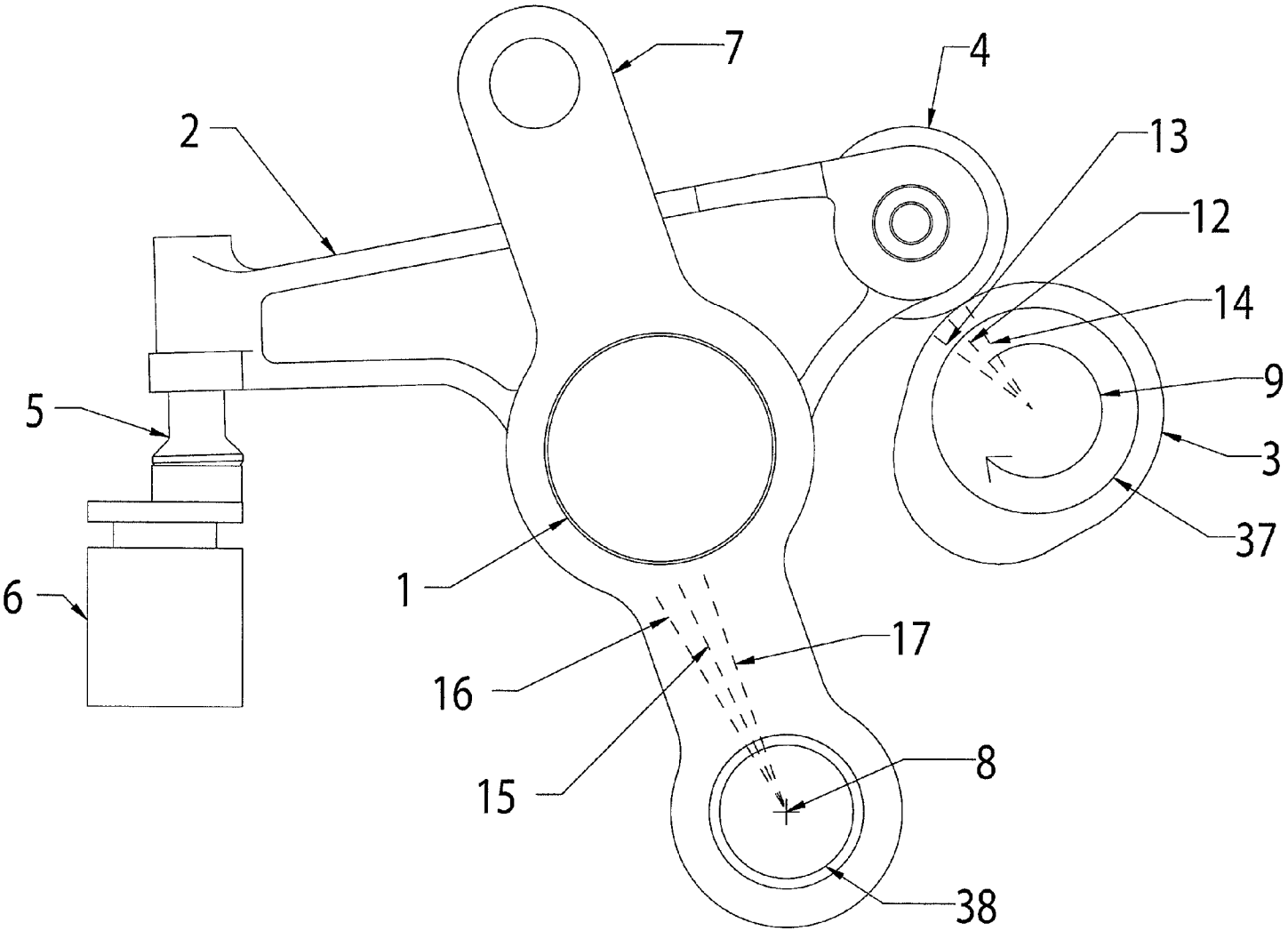
FIG. 2C shows a side-on view of the same mechanism as in FIG. 1A, with the rocker arm in a position of retarded timing.

FIG. 2B and FIG. 2C show the location of components in the centered and retarded positions respectively (arm actuator 10 and actuator axis 11 are not shown in these views). The angular movement required for the cam 3 to roller 4 phasing will be different for the angular movement required for different positions of control arm 7. Please note the change in position of elephant's foot 5 with respect to the valve or injector 6 in each of the three views.

Figure 3:
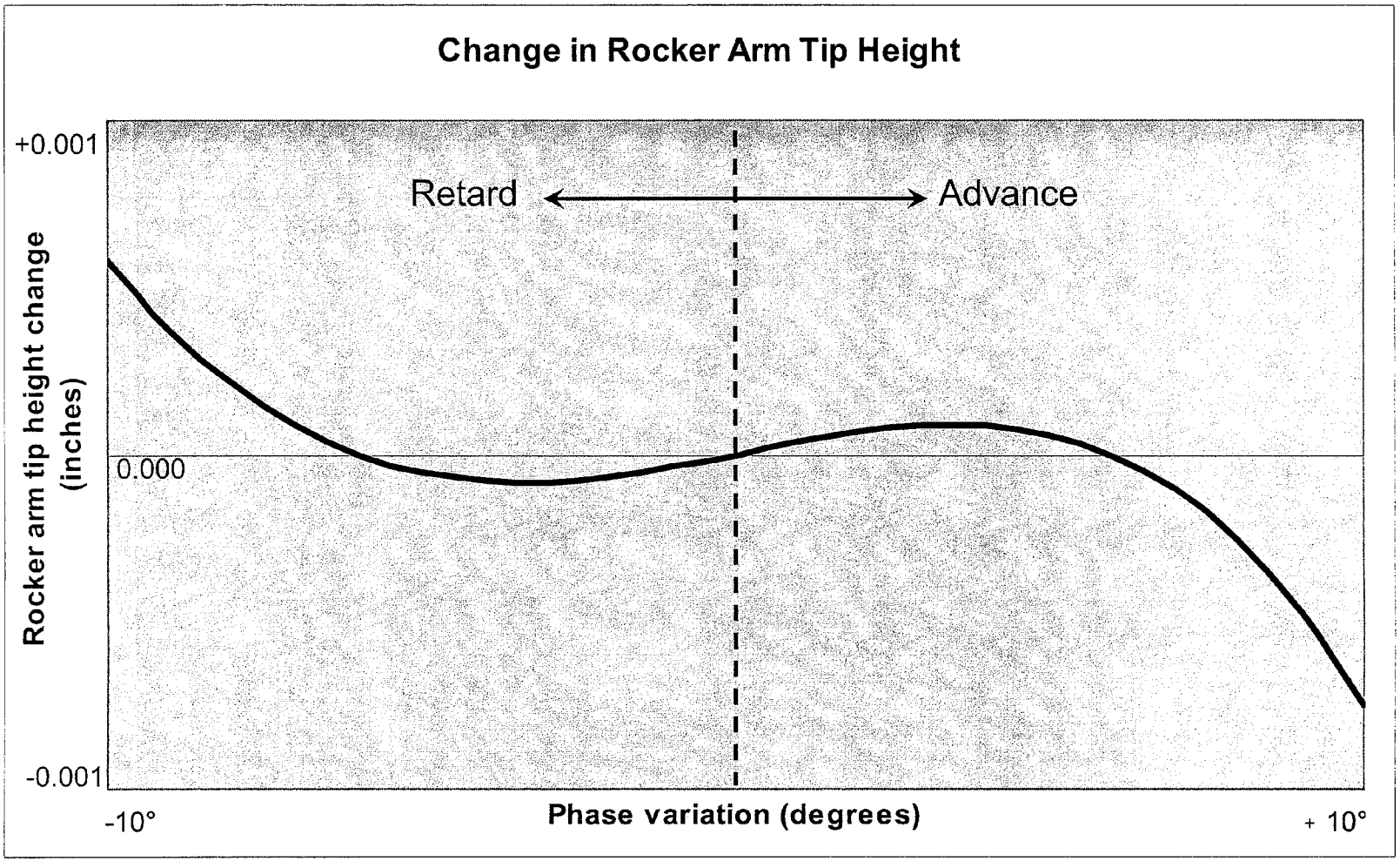
FIG. 3 shows an example plot of the minimal change in rocker arm tip height as the rocker arm is phased through its range.

FIG. 3 shows a plot of the minimal change in height of the rocker arm tip throughout a selected range of phasing of the mechanism. Since there is only a very small height change of the rocker arm tip as the rocker arm moves through its phasing path, the valve and injector height remain essentially constant during the phasing movement when cam 3 is on the base circle of the cam. Movement from the retarded position to the advanced position is approximately between about −10° to +10° or any range there between. The minimal change in height of the rocker arm tip is approximately between −0.001" to +0.001". Changes of movement more than −10° to +10° or changes of rocker arm tip height of more than −0.001" to +0.001" are within the scope of this invention, and the ranges listed are just those that have produced good results, but other ranges may also be acceptable.

Figure 4:
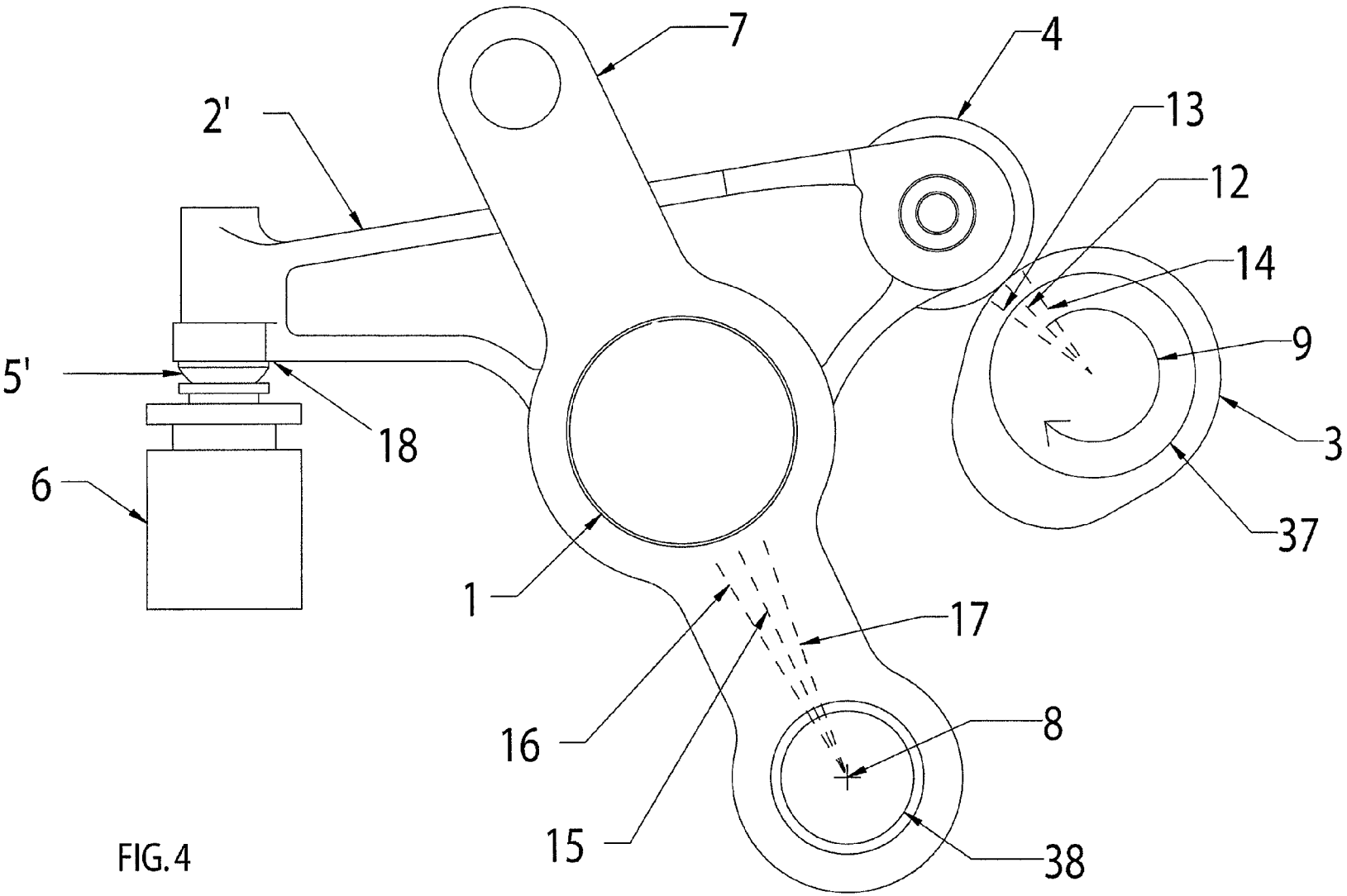
FIG. 4 shows the same overall geometry as in FIG. 2, with the exception that the elephant's foot contactor between the rocker arm and the valve or injector is now located on the valve or injector. The underside of the rocker arm adjuster tip is flat.

FIG. 4 shows in an alternate embodiment a side-on view of the mechanism in a centered position, but with the elephant's foot 5' now attached to the valve or injector 6 instead of rocker arm 2' as shown in FIGS. 2A, 2B, and 2C. Flat surface 18 on the underside of rocker arm 2' is shown as being flat. Flat surface 18 of rocker arm 2' may also correspond to the bottom of a lash adjuster fitted to rocker arm 2'.

Figure 5A:
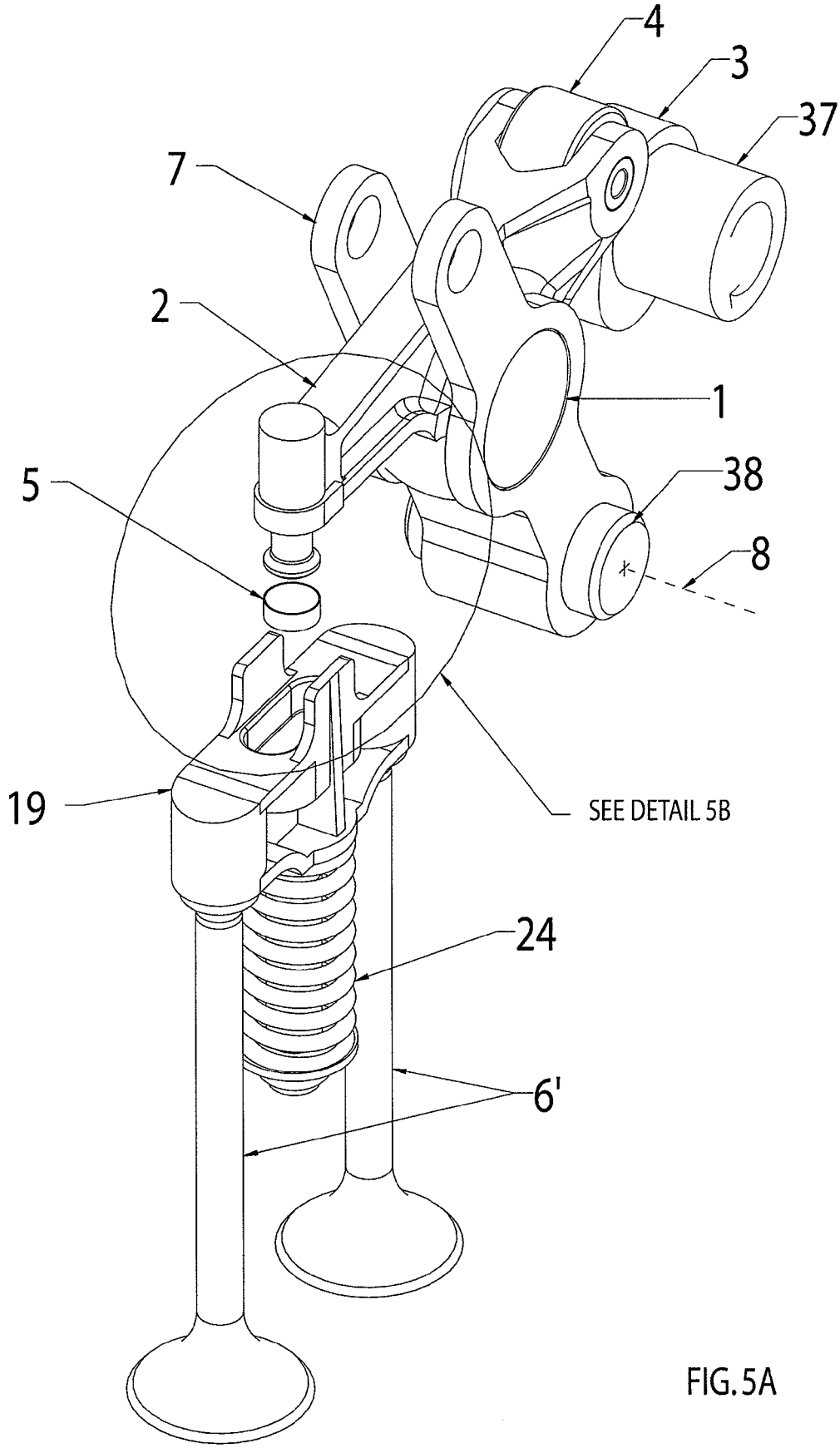
FIG. 5A shows an isometric view of the mechanism of FIG. 1A, but with the rocker arm actuating two valves via a bridge.
Figure 5B:
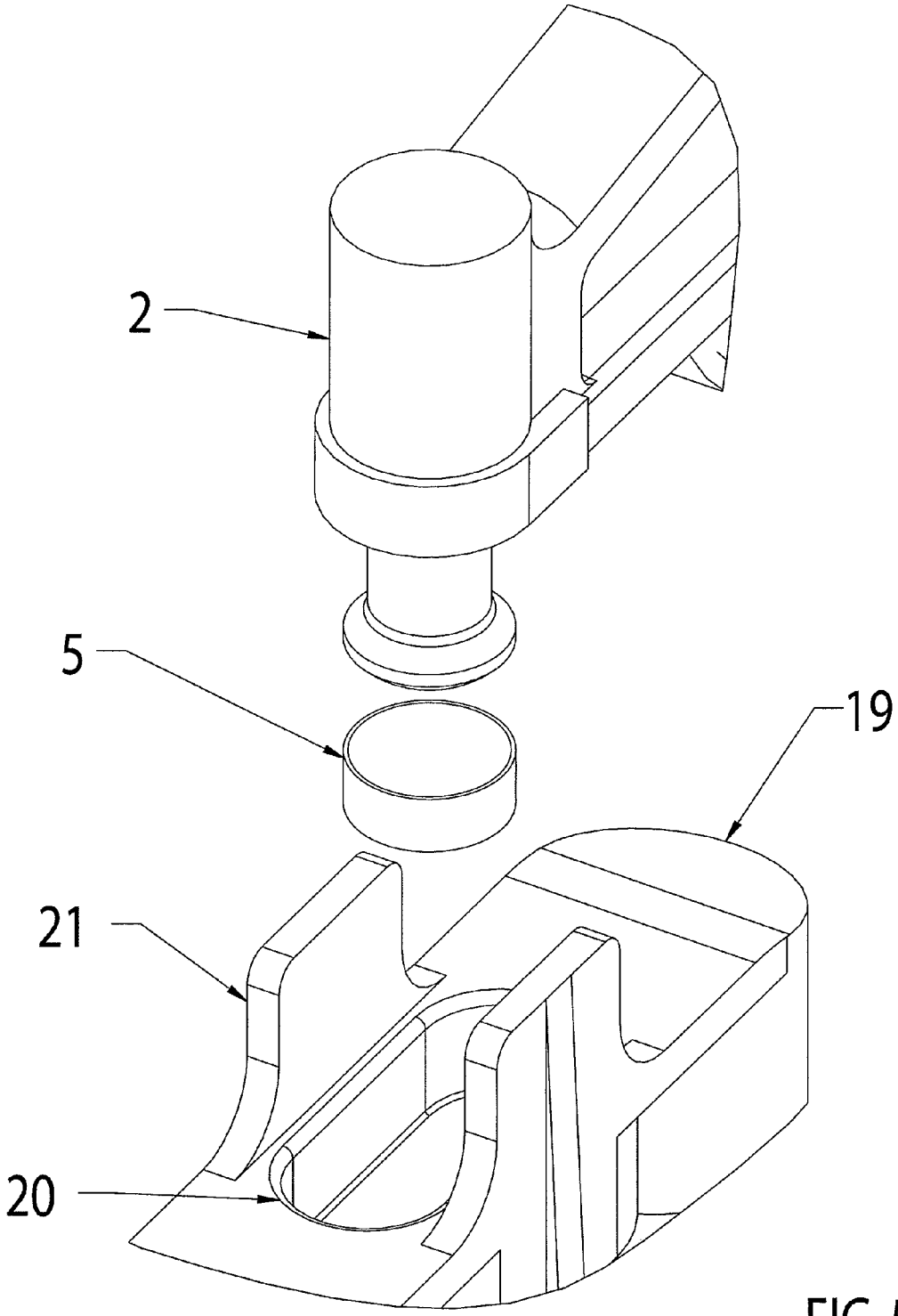
FIG. 5B shows a detailed view of the elephant's foot and the slot into which it fits in the bridge.

FIG. 5A shows an isometric view of the mechanism in FIG. 1A, but with rocker arm 2 actuating two valves or injectors 6' via bridge 19. Valves or injectors 6' via bridge 19 are biased by spring 24. Shown in greater detail in FIG. 5B is a suitable slot 20 shown in bridge 19 to constrain movement of elephant's foot 5 during motion of rocker arm 2. Bridge 19 has tangs 21 that capture the end of rocker arm 2 to ensure that bridge 19 is properly constrained.

Figure 6A:
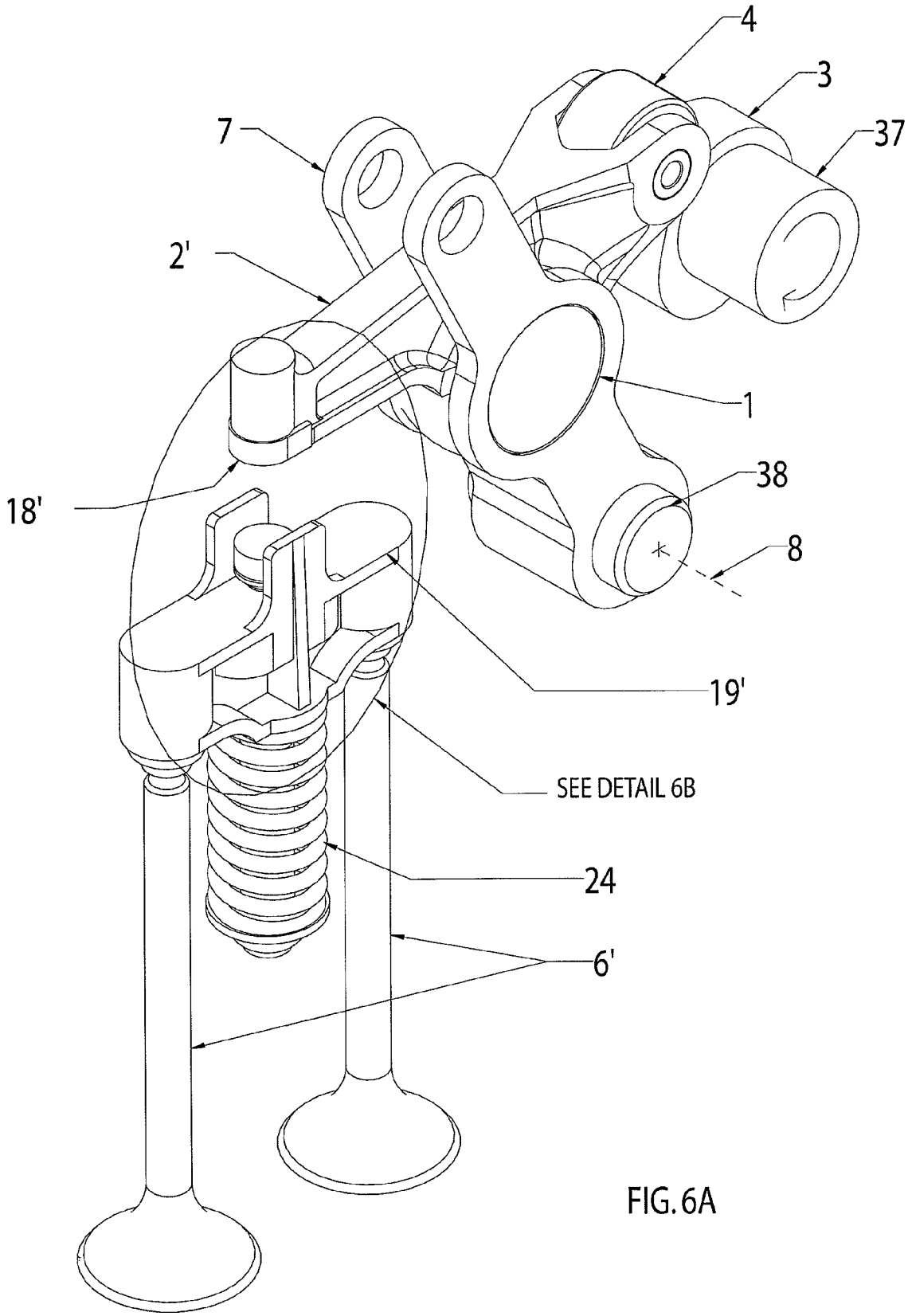
FIG. 6A shows the same general view of a rocker arm acting on a bridge for two valves as in FIGS. 5A and 5B, but with the elephant's foot attached to the bridge.

FIG. 6A shows in an alternate embodiment an isometric view of the mechanism in FIG. 4, but with the rocker arm 2' actuating two valves or injectors 6' via bridge 19'. Flat surface 18' on the underside of rocker arm 2' is flat. Flat surface 18' may also correspond to the bottom of a lash adjuster fitted to rocker arm 2'.

Figure 6B:
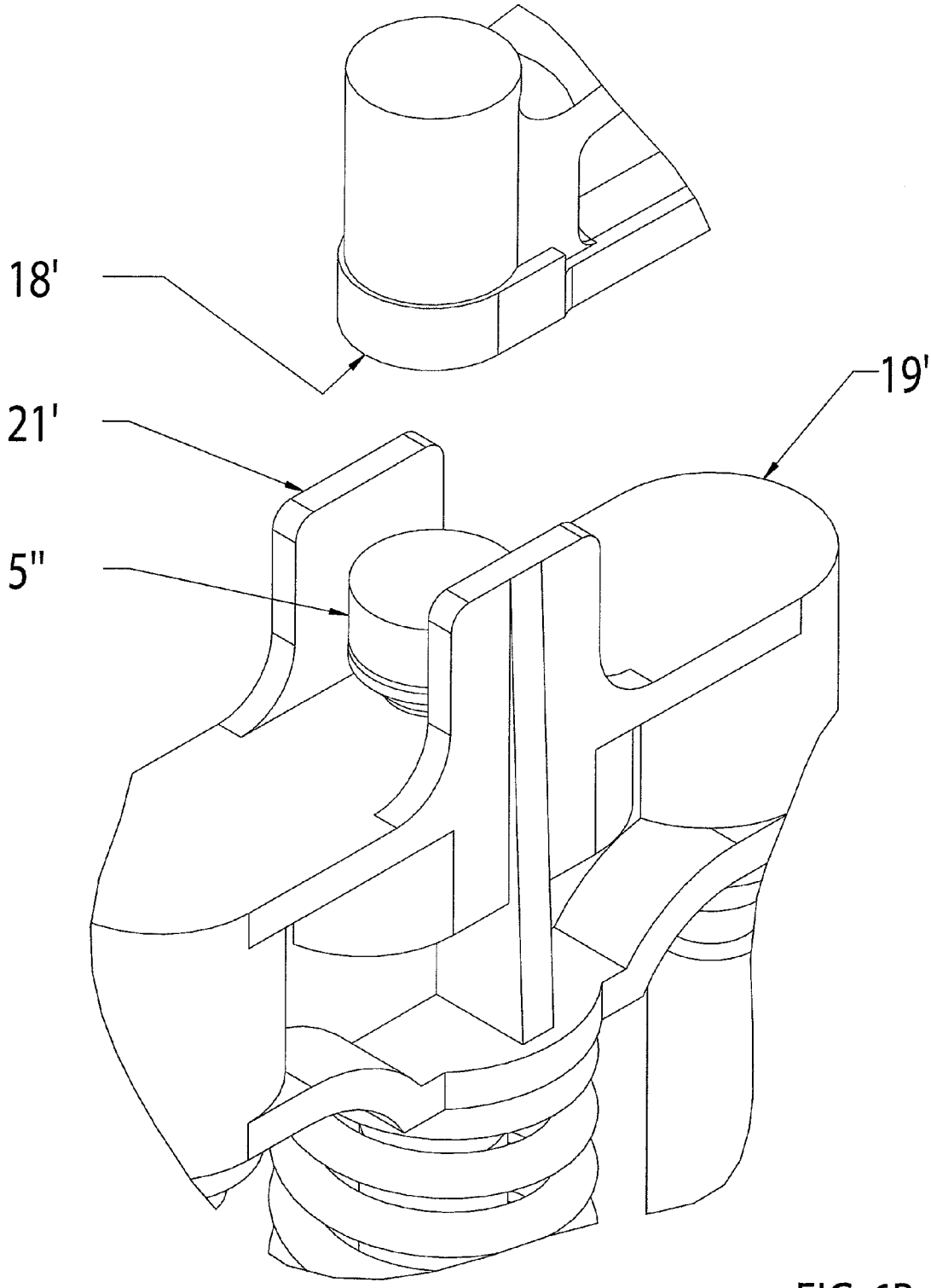
FIG. 6B shows a detailed view of the elephant's foot mounted to the bridge.

FIG. 6B shows in greater detail the elephant's foot 5" now attached to bridge 19'. Bridge 19' has tangs 21'. Flat surface 18' on the underside of rocker arm 2' is flat. Flat surface 18' may also correspond to the bottom of a lash adjuster fitted to rocker arm 2'.

Figure 6C:
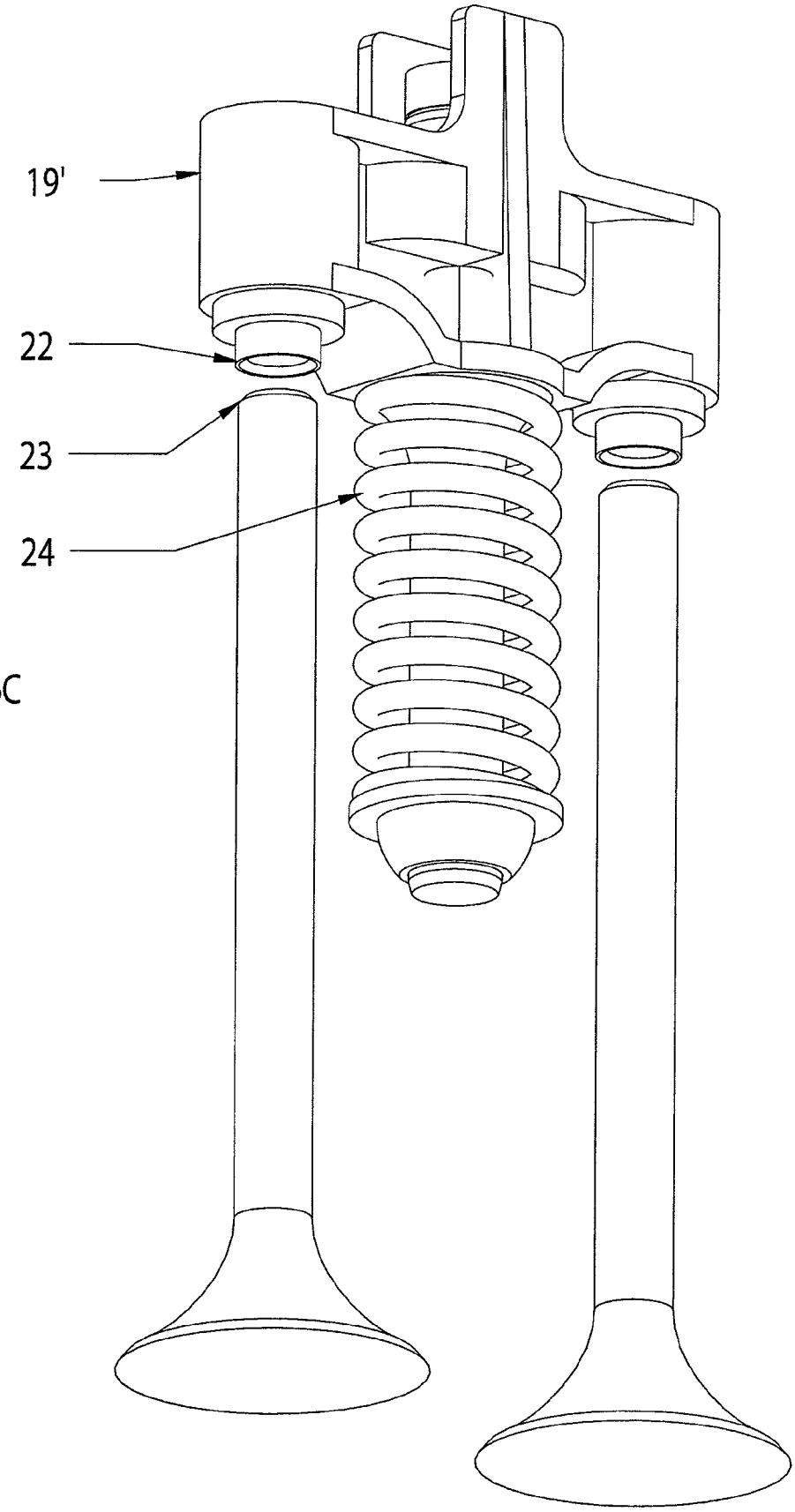
FIG. 6C shows a detailed view of the underside of the bridge with a retaining cap to capture the valve tip.

FIG. 6C shows a detailed view of the underside of the bridge 19' with a recessed retaining cap 22 to capture the top of valve tip 23.

Figure 7A:
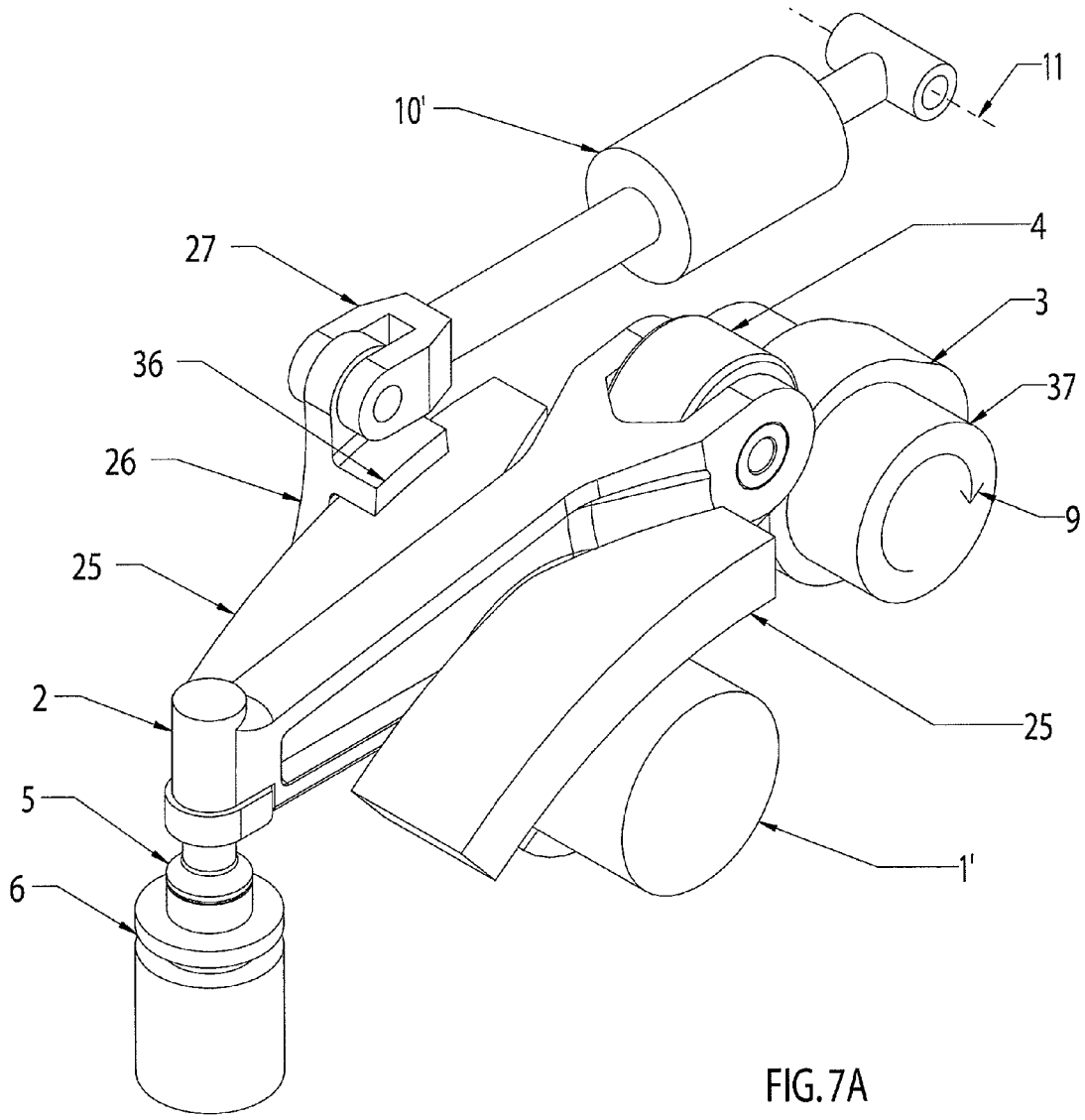
FIG. 7A shows an isometric view similar to FIG. 1A but where the circular movement path of the pivot shaft is determined by the shaped underside of a fixed cap, with the pivot shaft in contact with the cap.

FIG. 7A shows an isometric view of similar to FIG. 1A but where the circular movement path of pivot shaft 1' is determined by the shaped underside of curved caps 25. In this case the pivot shaft 1' is longer than pivot shaft 1 in FIG. 1A (and elsewhere) to allow for contact with constraining curved caps 25. In FIGS. 1A and 2A (and elsewhere with the same features) control arm 7 for pivot shaft 1 is shown hinged at its pivot axis 8. The undersides of curved caps 25 have a radius whose imaginary center corresponds to pivot axis 8 as shown in FIG. 1A and others. Control arm 26 has lip 36 whose geometry captures curved caps 25 on the top surface, and pivot shaft 1' captures curved caps 25 on its lower surface. Thus, when arm actuator 10' changes length, control arm 26 and pivot shaft 1' are translated. Connector 27 joins arm actuator 10' to control arm 26.

Figure 7B:
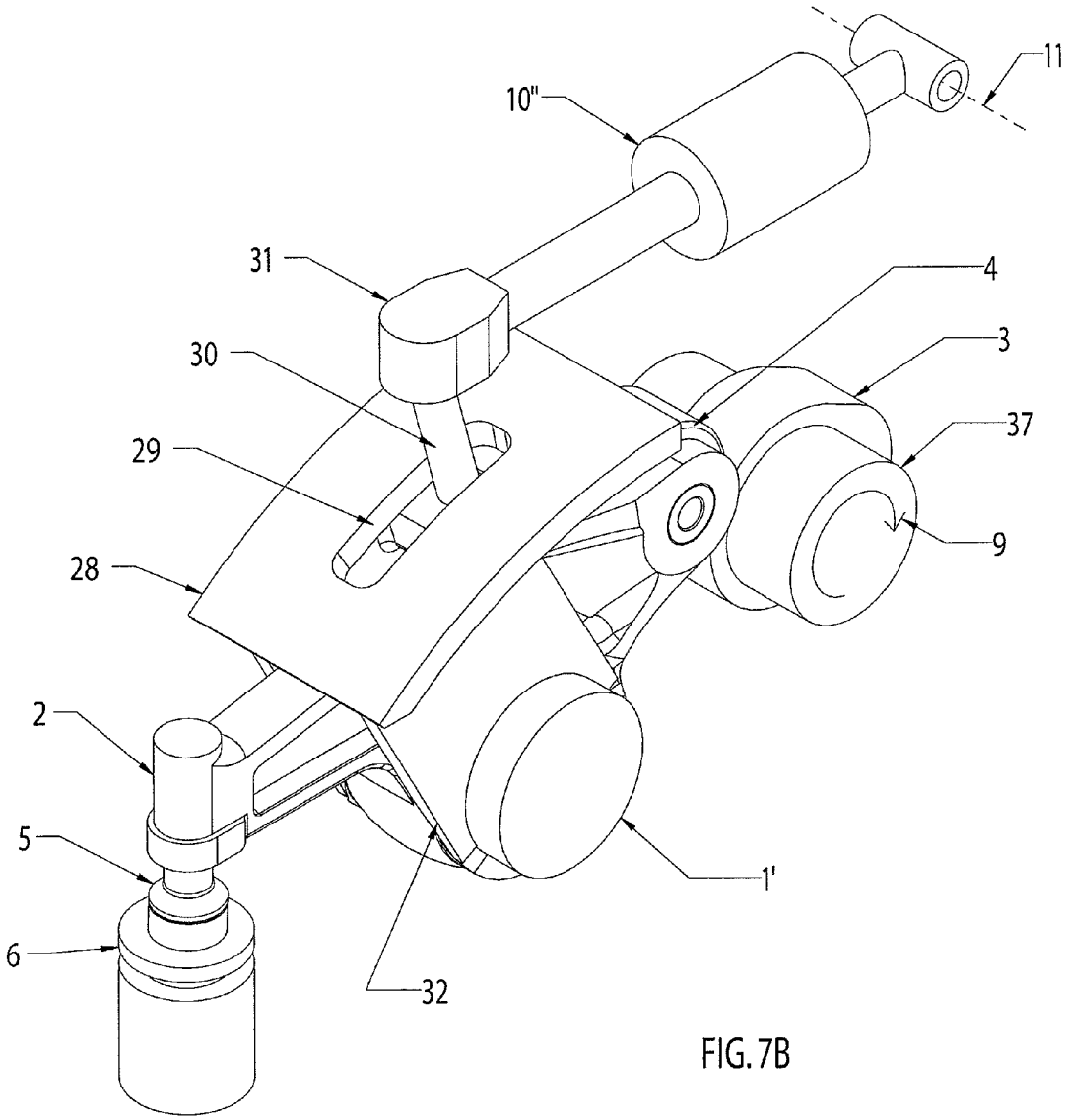
FIG. 7B shows a similar configuration to FIG. 7A but with a load bearing member inserted between the pivot shaft and cap with the circular underside.

FIG. 7B shows a similar isometric view of the geometry described in FIG. 7A but with a load-bearing member 32 interposed between pivot shaft 1' and a single piece curved cap 28. Load-bearing member 32 allows curved cap 28 (corresponding to curved caps 25 in FIG. 7A) to be a single piece sitting above rocker arm 2. Slot 29 in curved cap 28 allows control arm 30, which is connected rigidly to load-bearing member 32 (not shown) to extend above curved cap 28 where connector 31 joins control arm 30 to arm actuator 10". The underside of curved cap 28 has a radius whose imaginary center corresponds to pivot axis 8 as shown in FIG. 1A (and elsewhere). Load-bearing member 32 sits on pivot shaft 1' and may fit snugly over pivot shaft 1' so that they are clipped together. Pivot shaft 1' and load-bearing member 32 are biased upwards by suitable means well know in the art (not shown) to maintain contact with curved cap 28.

Figure 8A:
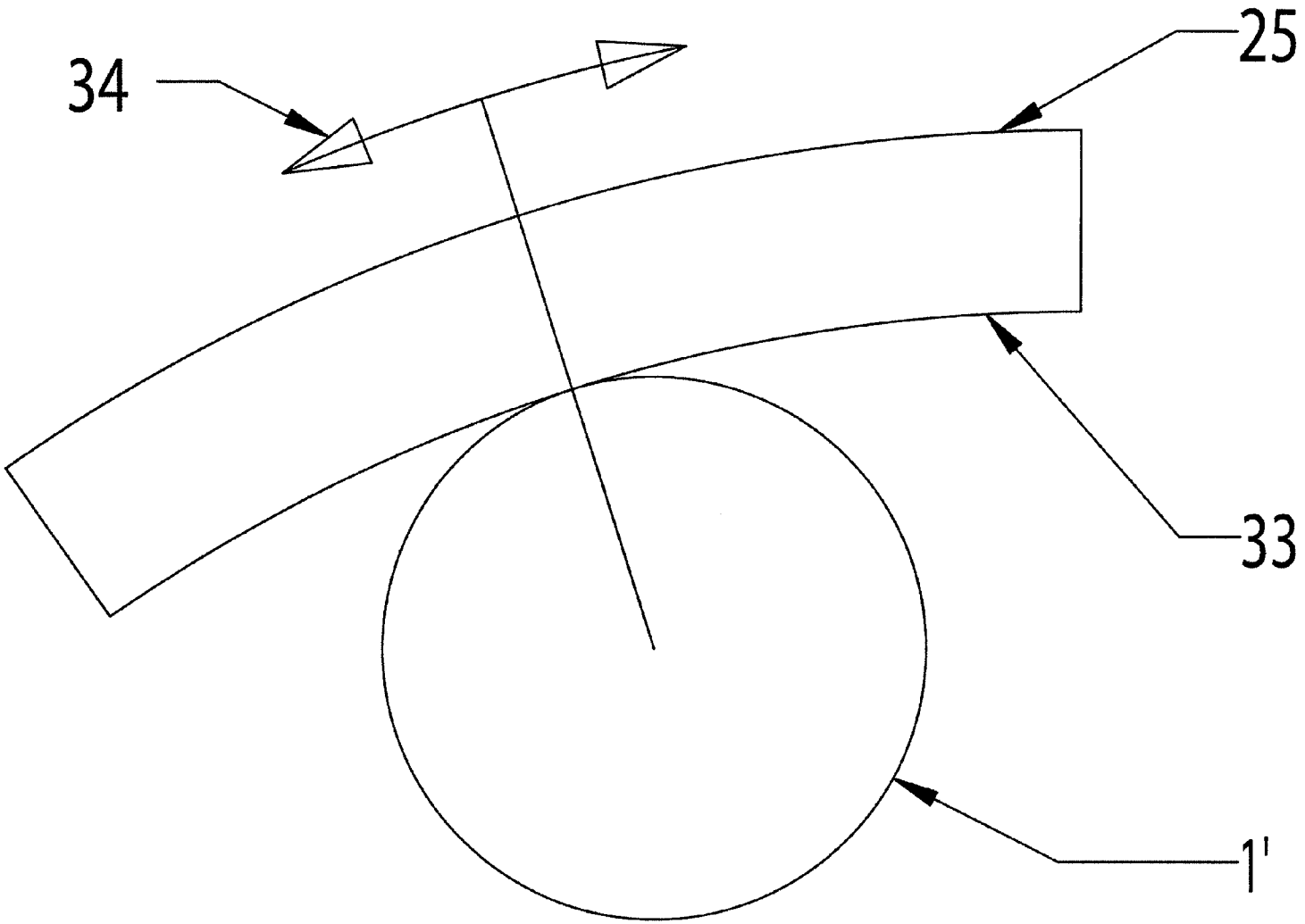
FIG. 8A shows a side view of the geometry in FIG. 7A, with the pivot shaft cap of the appropriate radius and location to allow the correct pivot shaft movement, thus maintaining rocker arm tip height to a minimal change.

FIG. 8A shows a side view of FIG. 7A with pivot shaft 1' in contact with curved caps 25. The circular arc movement of pivot shaft 1', represented by arrow 34, is achieved by movement of pivot shaft 1' along curved surface 33 whose imaginary center of curvature corresponds to pivot axis 8 (as shown in FIG. 1A and elsewhere.)

Figure 8B:
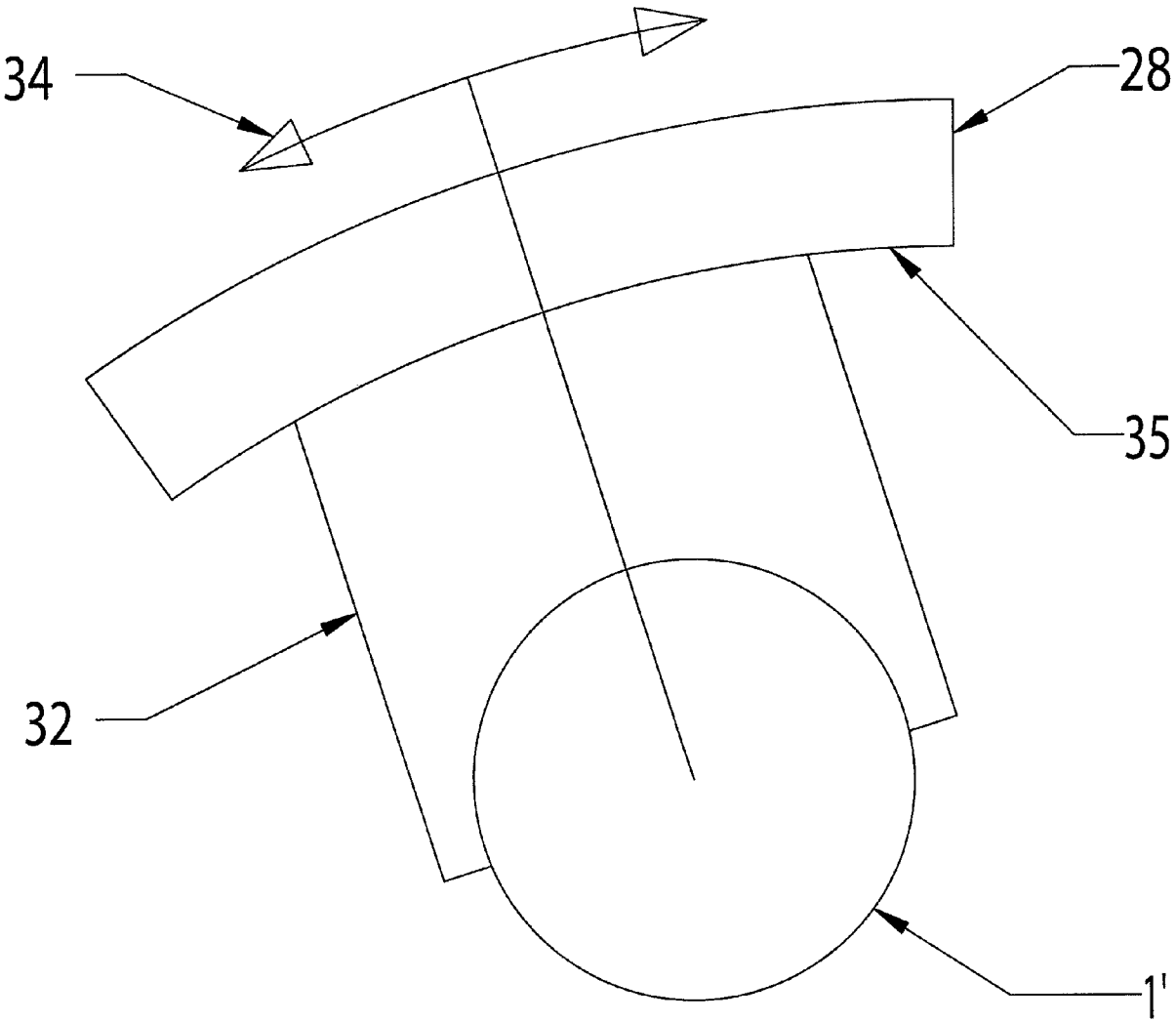
FIG. 8B shows a side view to FIG. 7B with a load distributing member between the pivot shaft and cap.

FIG. 8B shows a side view of FIG. 7B. The purpose of load-bearing member 32 is to distribute the forces more controllably between pivot shaft 1' and curved cap 28, and may be useful for elevating curved cap 28 to allow for clearance between it and rocker arm 2. Load-bearing member 32 may fit snugly over pivot shaft 1' so that they are clipped together. Suitable means well known in the art are used to bias curved cap 28 to maintain contact with curved surface 35 of curved cap 28 (not shown).

What is claimed is:

1. A method for varying the phase and lift of a rocker arm on a camshaft actuating a valve or injector, the method comprising the steps of:

(a) pivotably connecting the rocker arm to a control arm about a pivot shaft, wherein a roller on a first end of the rocker arm rotatably engages with a cam, and a second end of the rocker arm slidably engages with a first valve or injector;

(b) from a zero phase position of the roller in respect to a base circle of the cam, advancing an actuator causing the control arm to rotate in a first direction about a control arm pivot axis located at a first end of the control arm to an advanced phase position thereby advancing a timing of the first valve or injector; and (c) from the advanced phase position, reversing the actuator, causing the control arm to rotate in a second direction about the control arm pivot axis to a retarded phase position thereby retarding the timing of the first valve or injector.

2. The method according to claim 1 wherein the pivot shaft moves in a substantially circular arc.

3. The method according to claim 2, wherein a height of the rocker arm changes minimally as the pivot shaft moves in the substantially circular arc.

4. The method according to claim 2 further comprising the step of:

slidably engaging an elephant's foot attached to the second end of the rocker arm with the valve or injector, wherein a height of the rocker arm changes insignificantly as the pivot shaft moves in the substantially circular arc.

5. The method according to claim 2 further comprising the step of:

slidably engaging an elephant's foot attached to the valve or injector with the second end of the rocker arm, wherein a height of the rocker arm changes insignificantly as the pivot shaft moves in the substantially circular arc.

6. The method according to claim 1 further comprising the step of:

attaching a first end of the actuator to a second end of the control arm, wherein a second end of the actuator rotates about an actuator axis, and the actuator increases and decreases its length from the actuator axis to cause the control arm to rotate in the first direction and in the second direction.

7. The method according to claim 1 further comprising the step of:

attaching the actuator to a shaft having the control arm pivot axis running therethrough, wherein the actuator rotates clockwise and counterclockwise about the control arm pivot axis to cause the control arm to rotate in the first direction and the second direction.

8. The method according to claim 1 wherein a range between the advanced phase position and the retarded phase position is between about −10° to +10°.

9. The method according to claim 1 further comprising the step of:

actuating with the actuator a second valve or injector through a bridge connected to the first valve or injector and the second valve or injector.

10. An apparatus for variable valve timing, the apparatus comprising:

a rocker arm pivotably connected to a control arm about a pivot shaft;

a roller located on a first end of the rocker arm;

a cam, wherein the cam rotatably engages with the roller; and a first valve or injector, wherein a second end of the rocker arm slidably engages with the first valve or injector;

wherein from a zero phase position of the roller in respect to a base circle of the cam, an actuator connected to the control arm is advanced and the control arm rotates in a first direction about a pivot axis located at a first end of the control arm to an advanced phase position thereby advancing a timing of the first valve or injector, and further wherein, when the actuator is reversed, the control arm rotates in a second direction about the pivot axis to a retarded phase position thereby retarding the timing of the first valve or injector.

11. The system according to claim 10 wherein the pivot shaft moves in a substantially circular arc.

12. The system according to claim 11 further comprising:

an elephant's foot attached to the second end of the rocker arm that slidably engages with the valve or injector, wherein a height of the rocker arm changes insignificantly as the pivot shaft moves in the substantially circular arc.

13. The system according to claim 11 further comprising:

an elephant's foot attached to the valve or injector that slidably engages with the second end of the rocker arm, wherein a height of the rocker arm changes insignificantly as the pivot shaft moves in the substantially circular arc.

14. The system according to claim 11 wherein a height of the rocker arm changes minimally as the pivot shaft moves in the substantially circular arc.

15. The system according to claim 10 wherein a first end of the actuator is attached to a second end of the control arm, wherein a second end of the actuator rotates about an actuator axis, and the actuator increases and decreases its length from the actuator axis to cause the control arm to rotate in said first direction and in said second direction.

16. The system according to claim 10 further comprising:

a shaft having the pivot axis running therethrough, wherein the actuator is attached to the shaft and the actuator rotates clockwise and counterclockwise about the pivot axis to cause the control arm to rotate in the first direction and the second direction.

17. The system according to claim 10 wherein a range between the advanced phase position and the retarded phase position is between about −10° to +10°.

18. The system according to claim 10 further comprising:

a second valve or injector; and a bridge connecting the first valve or injector and the second valve or injector, wherein the actuator actuates both of the first valve or injector and the second valve or injector.

19. A method for variable valve timing, the method comprising the steps of:

(a) rotating a control arm in a first direction about a pivot axis located at a first end of the control arm with an actuator wherein the control arm is moved to an advanced phase position from a zero phase position thereby advancing a timing of a first valve or injector relative to a rotation of a cam, both the cam and the first valve or injector being engaged by a rocker arm pivotably connected to the control arm; and (b) rotating the control arm in a second direction about the pivot axis by the actuator wherein the control arm is moved to a retarded phase position from the advanced phase position thereby retarding the timing of the first valve or injector relative to the rotation of the cam.

20. The method according to claim 19 further comprising the step of:

attaching a first end of the actuator to a second end of the control arm, wherein a second end of the actuator rotates about an actuator axis, and the actuator increases and decreases its length from the actuator axis to cause the control arm to rotate in the first direction and in the second direction.

21. The method according to claim 19 further comprising the step of:

attaching the actuator to a shaft having the pivot axis running therethrough, wherein the actuator rotates clockwise and counterclockwise about the pivot axis to cause the control arm to rotate in the first direction and the second direction.

22. The method according to claim 19 further comprising the step of:

actuating with the actuator a second valve or injector through a bridge connected to the first valve or injector and the second valve or injector.

23. An apparatus for variable valve timing, the apparatus comprising:

a rocker arm connected to a pivot shaft;

a roller located on a first end of the rocker arm;

a cam, wherein the cam rotatably engages with the roller; and a first valve or injector, wherein a second end of the rocker arm slidably engages with the first valve or injector;

wherein from a zero phase position of the roller in respect to a base circle of the cam, an actuator connected to the rocker arm is advanced and the pivot shaft rotates in a first direction about a pivot axis located at a first end of the control arm to an advanced phase position thereby advancing a timing of the first valve or injector, and further wherein, when the actuator is reversed, the pivot shaft rotates in a second direction about the pivot axis to a retarded phase position thereby retarding the timing of the first valve or injector.

24. The apparatus according to claim 23 wherein the pivot shaft moves in a substantially circular arc.

25. The apparatus according to claim 24 further comprising:

an elephant's foot attached to the second end of the rocker arm that slidably engages with the valve or injector, wherein a height of the rocker arm changes insignificantly as the pivot shaft moves in the substantially circular arc.

26. The apparatus according to claim 24 further comprising:

an elephant's foot attached to the valve or injector that slidably engages with the second end of the rocker arm, wherein a height of the rocker arm changes insignificantly as the pivot shaft moves in the substantially circular arc.

27. The apparatus according to claim 24 wherein a height of the rocker arm changes minimally as the pivot shaft moves in the substantially circular arc.

28. The apparatus according to claim 23 wherein a first end of the actuator is attached to a second end of a control arm, wherein a second end of the actuator rotates about an actuator axis, and the actuator increases and decreases its length from the actuator axis to cause the pivot shaft to rotate in said first direction and in said second direction.

29. The apparatus according to claim 23 further comprising:

a shaft having the pivot axis running therethrough, wherein the actuator is attached to the shaft and the actuator rotates clockwise and counterclockwise about the pivot axis to cause the pivot shaft to rotate in the first direction and the second direction.

30. The apparatus according to claim 23 wherein a range between the advanced phase position and the retarded phase position is between about −10° to +10°.

31. The apparatus according to claim 23 further comprising:

a second valve or injector; and a bridge connecting the first valve or injector and the second valve or injector, wherein the actuator actuates both of the first valve or injector and the second valve or injector.

* * * * *